US011697540B2

(12) United States Patent
Machata et al.

(10) Patent No.: US 11,697,540 B2
(45) Date of Patent: Jul. 11, 2023

(54) APPARATUS, SYSTEM, AND METHOD FOR POSITION-CONTROLLED PACKAGING

(71) Applicant: ERADOCATE, LLC, Mansfield, MA (US)

(72) Inventors: Matthew Machata, Mansfield, MA (US); Martin Johns, Mansfield, MA (US)

( * ) Notice: Subject to any disclaimer, the term of this patent is extended or adjusted under 35 U.S.C. 154(b) by 0 days.

(21) Appl. No.: 17/532,822

(22) Filed: Nov. 22, 2021

(65) Prior Publication Data

US 2022/0161984 A1 May 26, 2022

Related U.S. Application Data

(60) Provisional application No. 63/117,570, filed on Nov. 24, 2020.

(51) Int. Cl.
*B65D 81/07* (2006.01)

(52) U.S. Cl.
CPC ..... *B65D 81/07* (2013.01)

(58) Field of Classification Search
CPC ..... B65D 81/07; B65D 25/10
USPC ..... 248/184.1, 138, 311.2, 583, 137, 231.71, 248/179.1, 180.1, 183.1, 128, 130, 131, 248/912, 314, 126, 178.1, 141; 206/583, 206/521; 220/737, 324; 211/81; 224/282, 553
See application file for complete search history.

(56) References Cited

U.S. PATENT DOCUMENTS 2,493,043 A * 1/1950 Stipsky ..... G01C 17/00 33/355 R
2,512,636 A * 6/1950 Flynt ..... G10K 11/355 343/765
2,797,580 A * 7/1957 Taylor ..... G01C 19/16 74/5 F
2,926,879 A * 3/1960 Dietrich ..... B63B 29/12 224/406
3,045,962 A * 7/1962 Paulus ..... B63B 29/12 248/314
3,051,428 A * 8/1962 Schult ..... E06C 7/146 248/231.51
3,656,649 A * 4/1972 Martin ..... B65D 85/38 248/184.1
3,840,204 A * 10/1974 Thomas ..... B63B 29/12 224/406
3,979,090 A * 9/1976 Brickner ..... G01C 21/18 244/175

(Continued)

OTHER PUBLICATIONS

International Search Report and Written Opinion issued in PCT Application No. PCT/US21/60373, dated Feb. 8, 2022, 9 pgs.

*Primary Examiner* — Chun Hoi Cheung
*Assistant Examiner* — Brijesh V. Patel
(74) *Attorney, Agent, or Firm* — Hayes Soloway P.C.

(57) ABSTRACT

An apparatus, system, and related methods for position-control packaging are provided. The apparatus has an outer container. An inner container is positioned within the outer container. At least one arm is connected between the outer container and the inner container. The at least one arm supports the inner container within the outer container. At least two joints are within, or in mechanical communication with, the at least one arm. The at least two joints are configured to provide free rotational movement of the inner container relative to the outer container along two or more axes of rotation.

20 Claims, 8 Drawing Sheets

(56) References Cited

U.S. PATENT DOCUMENTS 4,013,170 A * 3/1977 Hutterer ..... B65D 81/07 206/583
4,093,166 A * 6/1978 Iida ..... B63B 29/12 248/311.2
4,191,350 A * 3/1980 Ormond ..... A01K 97/04 248/311.2
4,270,393 A * 6/1981 Osborne ..... G01C 19/16 248/583
4,282,529 A * 8/1981 Speicher ..... F16M 11/10 248/580
4,474,354 A * 10/1984 Field ..... F16M 11/10 248/580
4,819,843 A * 4/1989 Nakayama ..... B60N 3/103 220/737
4,877,164 A * 10/1989 Baucom ..... B60N 3/101 224/544
5,086,958 A * 2/1992 Nagy ..... B60R 11/00 224/570
5,190,257 A * 3/1993 Gradei ..... E06C 7/14 248/231.71
5,232,095 A * 8/1993 Childers ..... B65D 81/07 206/583
5,287,969 A 2/1994 Kehr ..... B65D 81/02
5,573,136 A * 11/1996 Page ..... A47G 23/0616 220/761
5,690,420 A * 11/1997 Saldana, Sr. ..... B60Q 1/2657 362/540
5,853,158 A * 12/1998 Riggle ..... A47G 23/0225 248/278.1
6,257,125 B1 * 7/2001 Pate ..... F24C 3/14 99/450
6,286,386 B1 * 9/2001 Spletzer ..... B62D 57/00 180/8.5
6,322,028 B1 * 11/2001 Fleckenstein ..... E06C 7/14 248/210
6,490,880 B1 12/2002 Walsh ..... F25D 3/08
6,531,990 B2 * 3/2003 Verkerk ..... H01Q 3/08 343/765
6,536,724 B2 * 3/2003 Furuta ..... F16M 11/123 248/583
6,764,051 B2 * 7/2004 Knight ..... B60N 3/103 248/311.2
8,220,655 B2 * 7/2012 Millstein ..... A47G 23/0225 294/142
8,789,801 B2 * 7/2014 Newman ..... B62B 1/24 248/661
9,402,508 B2 * 8/2016 Cothern ..... B62B 5/0003
10,086,734 B2 * 10/2018 Ferreira Orta ..... B60N 3/10
10,368,671 B2 * 8/2019 Berg ..... A45C 13/262
2003/0197104 A1 * 10/2003 Heybl ..... B60N 3/108 248/314
2006/0022106 A1 * 2/2006 Mackin ..... B60N 3/103 248/311.2
2006/0102514 A1 5/2006 Cognard ..... B65D 85/30
2007/0138225 A1 * 6/2007 Duchesne ..... B60R 11/00 224/544
2017/0146892 A1 * 5/2017 Wei ..... G03B 17/563
2019/0248562 A1 8/2019 Marotta ..... B65D 81/07

* cited by examiner

APPARATUS, SYSTEM, AND METHOD FOR POSITION-CONTROLLED PACKAGING

CROSS REFERENCE TO RELATED APPLICATION

This application claims benefit of U.S. Provisional Application Ser. No. 63/117,570 entitled, "Apparatus, system, and method for position-controlled packaging" filed Nov. 24, 2020, the entire disclosure of which is incorporated herein by reference.

FIELD OF THE DISCLOSURE

The present disclosure is generally related to packaging systems and more particularly is related to a position-controlled packaging system

BACKGROUND OF THE DISCLOSURE

Certain physical products have strict requirements for transportation. For example, many liquids are required to be shipped in containers which must be oriented in substantially upright positions in order to prevent leakage. Other products, such as chemicals or actively fermented food products, are often stored and transported in containers with air relief ports or valves which are used to ensure the equal pressurization of the interior of the container relative to an outside atmosphere. With these types of containers, the air relief ports are often positioned near the top of the container, such that the air relief port is in constant contact with the air or other gas in the container, which is less dense than the liquid and therefore naturally rises towards the top of the container.

In order to ensure that these air relief ports function as intended, the containers must be transported and stored in an upright or substantially upright position. If the container is stored on its side or upside down, for example, the chemical or liquid within the container may leak out of the air relief port, or the air relief port may not allow for the equalization of pressure. A failure with equalizing the pressure of the interior of the container relative to the outside atmosphere can eventually cause the container to explode or otherwise experience an undesired structural malfunction, such as a crack or membrane separation.

In the shipping and transportation industries today, to ensure that these types of containers are mainlined in the desired upright or substantially vertical positioning during shipment, transportation, and storage, the boxes or transportation mediums are often labeled with textual or picture instructions. For example, stickers reading "This Way Up" with an arrow pointing upwards, or other similar decals or instructions are conventionally used to specify the proper orientation of the box. However, these instructions are all too easy to ignore, especially by individuals tasked with the transportation and storage of thousands of similar packages in short time periods. As such, leakages and other problems are prone to occur far more often than desired.

Thus, a heretofore unaddressed need exists in the industry to address the aforementioned deficiencies and inadequacies.

SUMMARY OF THE DISCLOSURE

Embodiments of the present disclosure provide an apparatus, system, and related methods for position-control packaging. Briefly described, in architecture, one embodiment of the apparatus, among others, can be implemented as follows. The apparatus has an outer container. An inner container is positioned within the outer container. At least one arm is connected between the outer container and the inner container. The at least one arm supports the inner container within the outer container. At least two joints are within, or in mechanical communication with, the at least one arm. The at least two joints are configured to provide free rotational movement of the inner container relative to the outer container along two or more axes of rotation.

The present disclosure can also be viewed as providing apparatus for position-control packaging. Briefly described, in architecture, one embodiment of the apparatus, among others, can be implemented as follows. The apparatus for position-control packaging has an outer container. An inner container is positioned in a suspended position within the outer container. At least a first rotatable joint is connected to the outer container. At least a first arm is connected to the first rotatable joint at a first end of the first arm. At least a second rotatable joint is connected to a second end of the first arm, wherein the second end is substantially opposite the first end. At least a second arm is connected between the second rotatable joint and the inner container, wherein the first and second rotatable joints and the first and second arms hold the inner container in the suspended position within the outer container, and wherein the inner container has free rotational movement relative to the outer container along two or more axes of rotation, wherein a top surface of the inner container remains vertically upright irrespective of an orientation of the outer container.

The present disclosure can also be viewed as providing methods of using position-control packaging. In this regard, one embodiment of such a method, among others, can be broadly summarized by the following steps: providing an outer container; suspending an inner container within the outer container with at least one arm connected between the outer container and the inner container; and allowing free rotational movement of the inner container relative to the outer container along two or more axes of rotation with at least two joints within, or in mechanical communication with, the at least one arm, whereby a top surface of the inner container remains vertically upright irrespective of an orientation of the outer container.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

To overcome the deficiencies previously noted, the subject application is directed to an apparatus, system, and method for position-control packaging. As described in detail relative to FIGS. 1-7 herein, position-control packaging allows a position-sensitive container, such as one carrying chemicals, or a container with a gas vent, to be kept in the desired orientation during shipment, transportation, storage, or any other time when the container is being used, stored, or transported. Accordingly, use of the position-control packaging apparatus, system, or method may increase safety and reduce human error when shipping or storing a package that must be kept upright.

Figure 1:
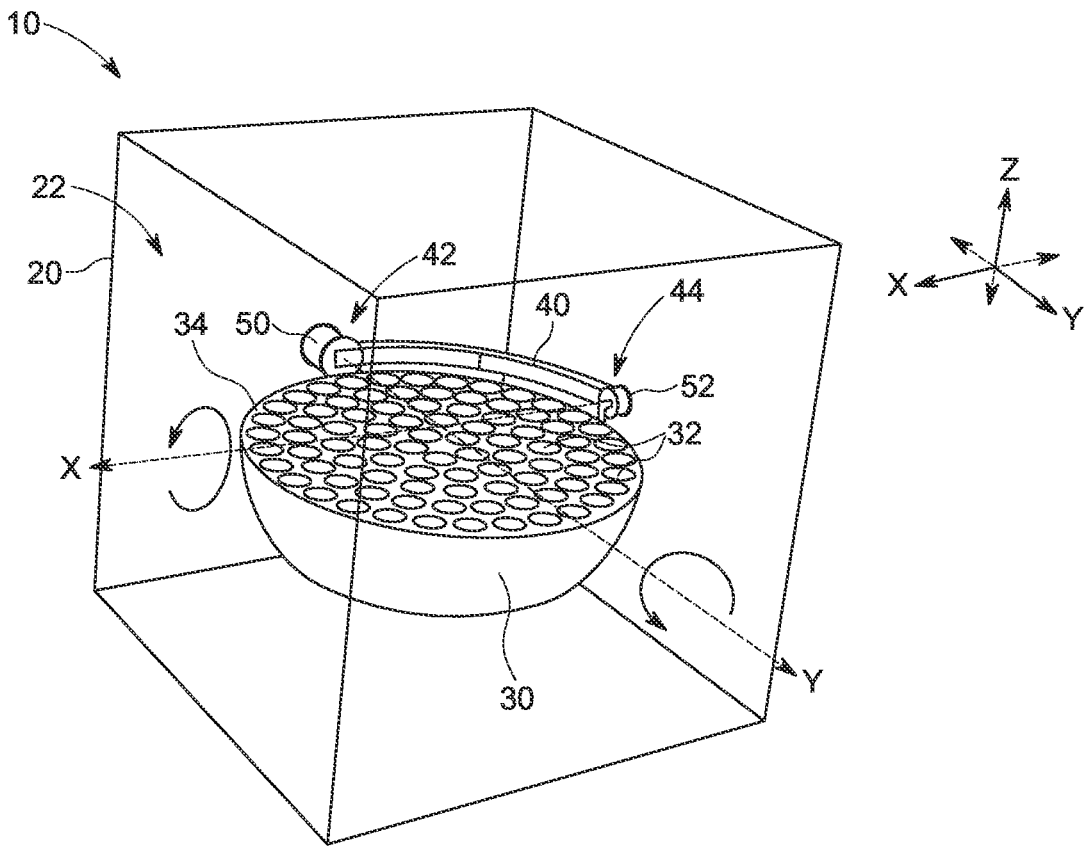
FIG. 1 is a perspective view illustration of an apparatus for position-control packaging, in accordance with a first exemplary embodiment of the present disclosure.

The position-control packaging apparatus 10 is described in detail relative to FIG. 1, which is a perspective view illustration of an apparatus for position-control packaging, in accordance with a first exemplary embodiment of the present disclosure. As shown, the position-control packaging apparatus 10, which may be referred to herein simply as 'apparatus 10', includes an outer container 20. The outer container 20 may include any type of container unit or housing unit which has an interior space 22 therein for carrying objects. For example, the outer container 20 may include a cube or cuboid-shaped box which has a plurality of walls which are interconnected to form a three-dimensional box with an interior space 22. While not depicted in FIG. 1, the outer container 20 may have one or more doors or access ports which allow the interior space 22 to be accessed from an exterior of the outer container 20. For example, the outer container 20 may include a hinged, pivotable, or otherwise movable panel which is removably closable, thereby allowing the interior space 22 to be accessed when desired or closed off from access.

In FIG. 1, the outer container 20 is depicted as being substantially translucent or see-through, for clarity in disclosure of the inner container 30 and other components of the apparatus 10, but the outer container 20 may be made of metals, plastics, or other materials which are often not translucent. Similarly, in addition to the possibility of manufacturing the outer container 20 from metals or plastics, the outer container 20 may be constructed from any other type of material or combination thereof, such as wood, corrugated cardboard, or the like. In one example, the outer container 20 may include at least one sidewall which is formed from a material different from the other sidewalls, such as when the sidewall on which joint 50 of arm 40 is attached is manufactured from a highly durable and strong material, while the other sidewalls of the outer container 20 may be formed from other, less durable materials. This type of manufacturing may save costs with materials while still affording a durable container for transportation of the materials. The outer container 20 may be reusable, such that materials can be transported within it numerous times, but it is also possible to manufacture the outer container 20 to be disposable, such that after one use it is discarded. The outer container 20 may have any size and should have a sufficient durability to withstand conventional transportation methods, such as those involving trucking, shipping containers, dollies, forklifts, or other devices for transporting goods.

An inner container 30 is positioned within the outer container 20, such that the outer container 20 substantially encloses the inner container 30 within the interior space 22 of the outer container 20. The inner container 30 may have a variety of shapes, sizes, and be constructed from various materials, often metals, plastics, fiberglass, or similar materials. In FIG. 1, the inner container 30 is depicted as a truncated cylindrical shape which has a curved outer surface along the X-Y axes and has a substantially flat top surface 34 and a bottom surface, orthogonal to the Z axis. In other examples, the inner container 30 may have other shapes, such as semi-hemispherical, or the like. The inner container 30 may be sized to fit within the interior space 22 of the outer container 20 with such clearance, that the inner container 30 can be located centrally within the outer container 20 and the inner container 30 does not contact the sidewalls of the outer container 20, as will be described in greater detailer herein. It may be preferable for the inner container 30 to have curved or substantially curved outer edges to prevent inadvertent contact between the inner container 30 and the interior of the outer container 20. The shape of the inner container 30 may also be selected to provide a desired center of gravity with the inner container 30, thereby helping to ensure it remains in the upright position at all times. It may also be possible to include a weighted object or similar material within the inner container 30 to provide the intended center of gravity, as discussed further herein.

It is noted that the inner container 30 may have one or more receptacles 32 or compartments which are sized to receive the products intended for shipment or storage, either directly or by holding yet smaller vessels which contain the products intended for shipment or storage. For example, the receptacles 32 may include holes or cavities within the inner container 30 which are sized to receive bottles, packages, vials, or other packaging containers housing liquids, chemicals, or other products which are required to remain upright. The receptacles 32 may include any other type of structure capable of holding a packaging, including, for example, the use of fasteners, clips, hook and loop devices, guides or rails, or any other structure capable of holding a container of fluid, chemical, or another product. The inner container 30 may include any number of receptacles 32, depending on the design and intended use of the apparatus 10. For example, it may be possible to hold a large number of bottles or packages within a large number of receptacles 32, or the inner container 30 may be used to only hold a single bottle or package of the product. Other variations on the inner container 30 are also possible, such as the use of a lid which restrains the bottles or packages within the receptacles 32, or the use of another design of the inner container 30 where the bottle or packages are mounted to the side of the inner container 30.

Figure 2:
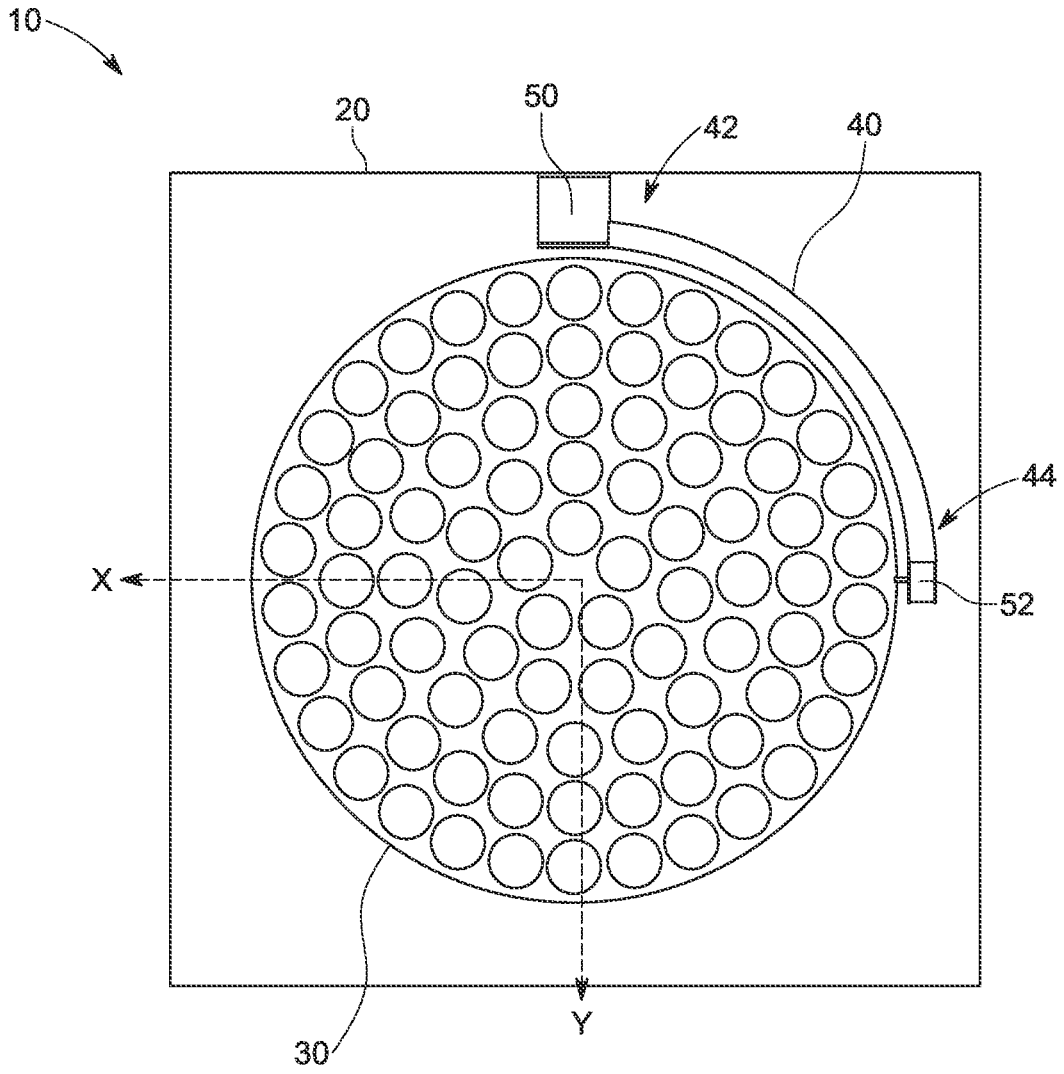
FIG. 2 is a top view illustration of the position-control packaging apparatus of FIG. 1, in accordance with the first exemplary embodiment of the present disclosure.
Figure 3A:
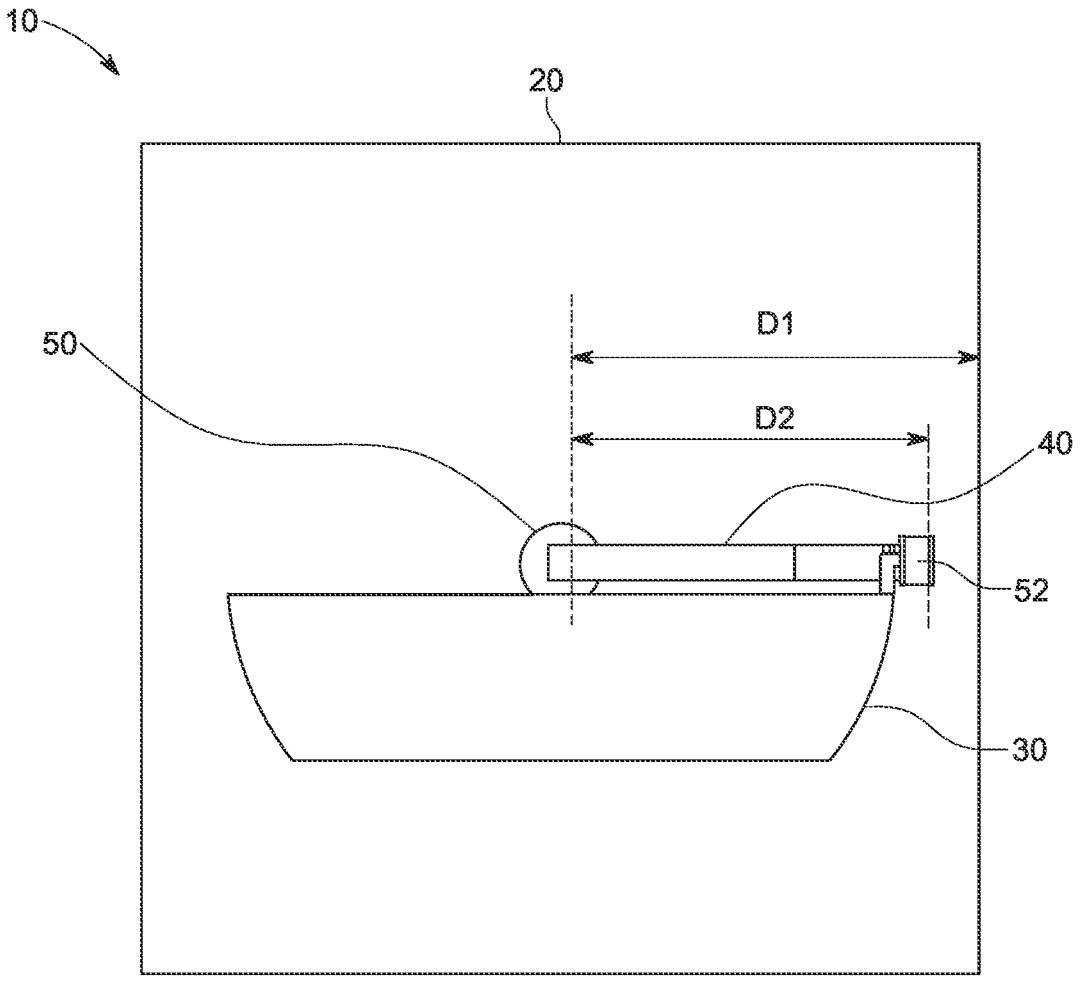
FIG. 3A is a side view illustration of the position-control packaging apparatus of FIG. 1, in accordance with the first exemplary embodiment of the present disclosure.
Figure 3B:
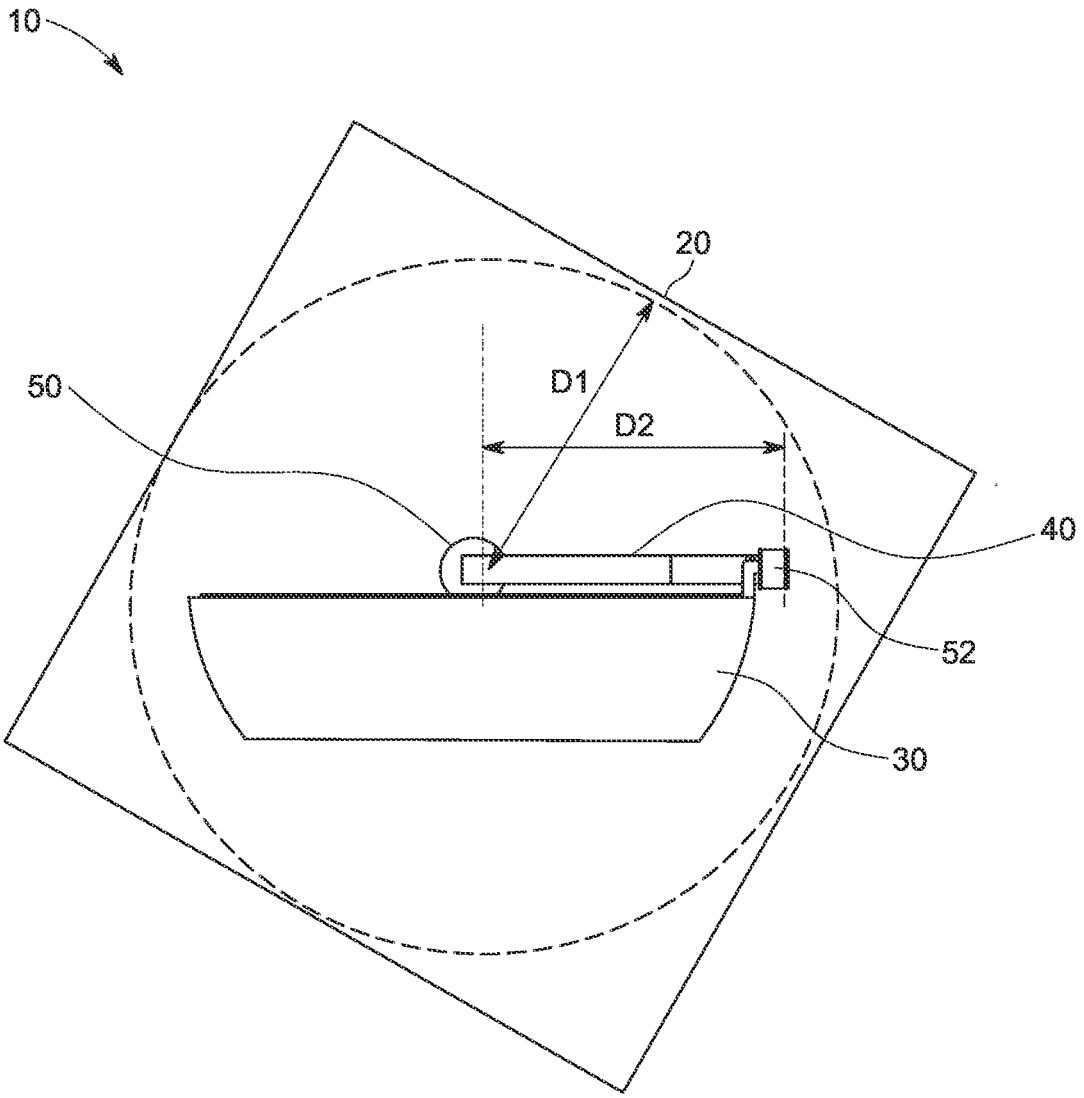
FIG. 3B is a side view illustration of the position-control packaging apparatus of FIG. 3A in a rotated position, in accordance with the first exemplary embodiment of the present disclosure.
Figure 4:
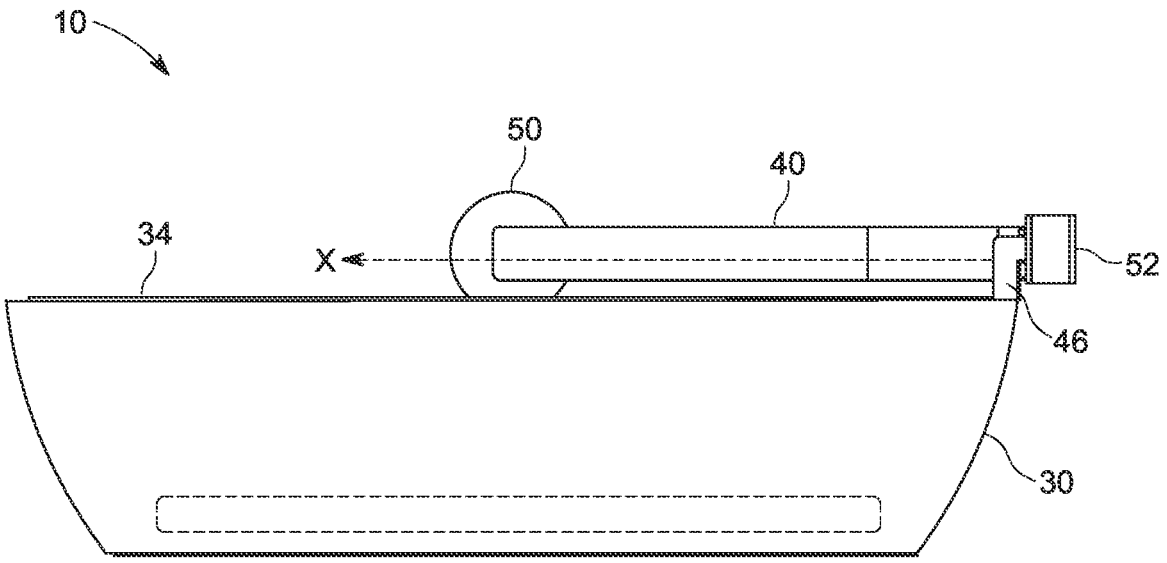
FIG. 4 is an enlarged, side view illustration of the inner container and arm of the position-control packaging apparatus of FIG. 3, in accordance with the first exemplary embodiment of the present disclosure.

As depicted in FIG. 1, there is at least one arm 40 connected between the outer container 20, and in particular, an interior surface of a sidewall of the outer container 20, and the inner container 30. FIGS. 2-4 provide additional views of the at least one arm 40, among other components of the apparatus 10. Specifically, FIG. 2 is a top view illustration of the position-control packaging apparatus of FIG. 1, FIG. 3A is a side view illustration of the position-control packaging apparatus of FIG. 1, FIG. 3B is a side view illustration of the position-control packaging apparatus of FIG. 3A in a rotated positioned, and FIG. 4 is an enlarged, side view illustration of the inner container and arm of the position-control packaging apparatus of FIG. 3, all in accordance with the first exemplary embodiment of the present disclosure.

Relative to FIGS. 1-4 together, the at least one arm 40 may be formed as a single, unitary arm or a plurality of arm linkages interconnected together to form an arm structure. The at least one arm 40 is sized and shaped to hold and support the inner container 30 in a substantially suspended position within the interior 22 of the outer container 20, such that the only point of mechanical connection between the inner container 30 and the outer container 20 is through the at least one arm 40. For example, as shown in the figures, the arm 40 may be connected between one of the interior surfaces of the sidewalls of the outer container 20, either directly or indirectly, and an exterior side or top 32 of the inner container 30 and is of sufficient strength and durability to carry the load of the weight of the inner container 30 and any products placed therein during transportation or storage.

While the shape, size, and positioning of the arm 40 may vary, depending on design, it may be common for the arm 40 to be connected to an inner surface of the sidewall of the outer container 20 and have a curved or arced shape which substantially matches the curvature of the inner container 30. The arm 40 may extend substantially 90° around the inner container 30 at which point it is connected to the inner container 30, as shown in FIGS. 1-4. In other examples, the at least one arm 40 may include a half-circle shape which connects to an opposing side of the inner container 30 from where the at least one arm 40 connects to the outer container 20, and/or it may utilize additional arm structures which allow movement of the inner container 30. This may include the use of a first arm which connects to the inner container 30 and a second arm which connects between the first arm and the outer container. Additional arms may also be used.

There are at least two joints 50, 52 within the arm 40, or in mechanical communication with the arm 40, such that movement can occur between the arm 40 and structures it is connected to (or between two or more arm members). In the example shown in FIG. 1, arm 40 is used and two joints 50, 52 are interfaced with the arm 40. The two joints 50, 52 may include a first joint 50 which is connected between a distal end 42 of the arm 40 and the outer container 20 sidewall, and a second joint 52 which is connected between a proximal end 44 of the arm 40 and the inner container 30. Each of the two joints 50, 52, is configured to provide free rotational movement of the inner container 30 relative to the outer container 20 along one axis of rotation, where the axis or rotation is different for each of the two joints 50, 52. This design ensures that with both joints 50, 52, the inner container 30 is capable of free rotational motion about two non-parallel axes of rotation. It is well understood that there are three axes of rotation, commonly called 'roll', 'pitch', and 'yaw'. Relative to FIG. 1, roll consists of rotational movement about the Y axis, pitch consists of rotational movement about the X axis, and yaw consists of rotational movement about the Z axis.

As shown in FIGS. 1-4, the joints 50, 52 are positioned along the Y and X axes, respectively, such that the inner container 30 can freely rotate about the Y and X axes, i.e., through its roll and pitch axes, yet the inner container 30 will remain static (non-rotatable) around the Z axis, i.e., the yaw axis. This ability of the inner container 30 to freely rotate about the Y and X axes ensures that the top surface 34 of the inner container 30 always faces upwards, regardless of how the outer container 20 is oriented. For example, as best understood relative to FIG. 1, as the outer container 20 is angled or rotated about the Y axis, the arm 40 will pivot or rotate at joint 50 relative to the outer container 20 to maintain the upwards orientation. As the outer container 20 is angled or rotated about the X axis, the arm 40 will rotate at joint 52 to ensure the inner container 30 remains facing upwards. With these rotation abilities, it is possible to maintain the upright positioning of the packages within the inner container 30 irrespective of the orientation of the outer container 20.

In constructing the apparatus 10, the outer container 20 must be large enough to accommodate the dimensions of the inner container 30 and the arm 40 (or arms) at any position or orientation of the inner container 30, such that when the outer container 20 is moved, the inner container 30 and arm 40 do not contact with the outer container 20, apart from at the joint 50, of course. In other words, the outer container 20 must be large enough to contain a sphere with a radius equal to a radius of the inner container 30 plus the width of the arm 40. As shown best relative to FIGS. 3A-3B, the outer container 20 may have an internal radius dimension, D1, which is larger than the radius dimension, D2, or the inner container 30 plus any portion of the arm 40 which extends beyond the footprint of the inner container 30. This must hold true for any position of orientation of inner container 30 relative to the outer container 20, such as when the outer container 20 is rotated, as depicted in FIG. 3B.

While the construction and design of the apparatus 10 can vary, in one example, the arm 40 is mounted at the central point of an inner face of the outer container 20, whereby joint 50 interfaces between the arm 40 and the outer container 20. From the perspective of looking two dimensionally at the center point of the inner face of the outer container 20, the arm 40 will freely rotate about the Y axis, which is the axis orthogonal to the top surface 34 of the inner container 30. This is the roll axis, and it is coming out of the inner face of the outer container 20 to which the joint 50 is mounted. The arm 40 is then extended around the sphere of the inner container 30 and is swept out by the rotation of the inner container 30, at which point the arm 40 is connected to the inner container 30. The arm 40 may connect to the inner container 30 in the horizontal plane of the X and Y axes from joints 50, 52, but in a position 90° from the Y axis (roll axis) from joint 50.

The connection of the arm 40 to the inner container 30 at this location is made with joint 52, which allows rotational freedom of movement around the X axis, which is the horizontal axis and is called the pitch axis. The inner container 30 is mounted such that its largest diameter resides in, or closest to, the horizontal plane of the X and Y axes, and is positioned in the vertical direction such that its center of gravity is below the X and Y axes. For example, as shown in FIG. 4, the inner container 30 may be mounted slightly below the X axis, whereby a second arm 46 interfaces the connection between joint 52 and the sidewall or top of the inner container 30. If the inner container 30 is mounted such that the top surface 34 is under but parallel to the central horizontal plane of the outer container 20, the upper diameter of the inner container 30 must be shortened to fit within the sphere swept out by the freely rotating arms 40. All lower dimensions of the inner container 30 must fit within the sphere swept out by the arms 40 to ensure that the inner container 30 will not inadvertently contact the outer container 20 during movement thereof. With this construction, in combination with the joints and relative positioning, the inner container 30 will always settle to an upright position when it is traveling at a constant or zero velocity.

It is further noted that a weight 36, as shown in FIG. 4, may be attached to, included within, or otherwise formed in or with the inner container 30, such as along its bottom portion or base, which may help ensure the inner container 30 maintains the desired orientation in the x-axis. The weight 36 may be positioned at the furthest point away from the origin to lower the center of gravity, thereby increasing stability and decreasing the effects of unevenly loading the inner container 30 with products.

Figure 5:
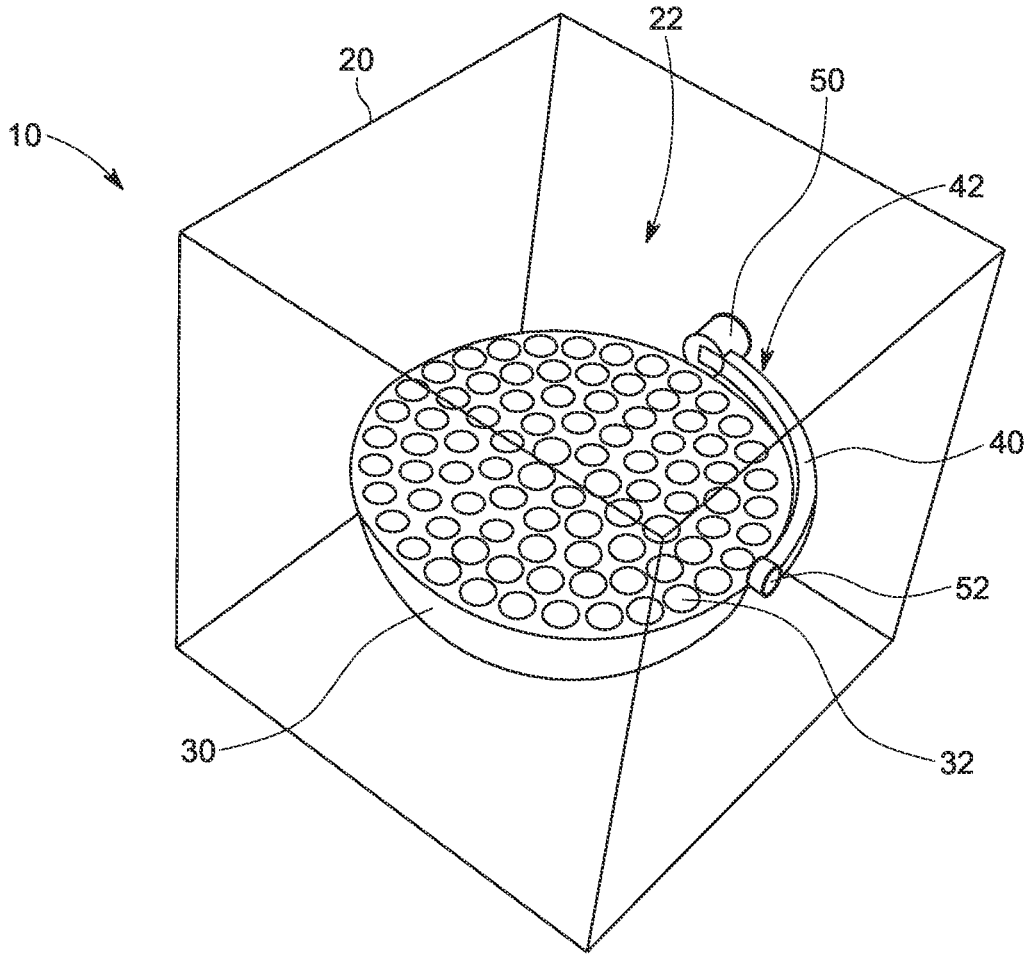
FIGS. 5-6 are perspective view illustrations of the position-control packaging apparatus of FIG. 1, in accordance with the first exemplary embodiment of the present disclosure.
Figure 6:
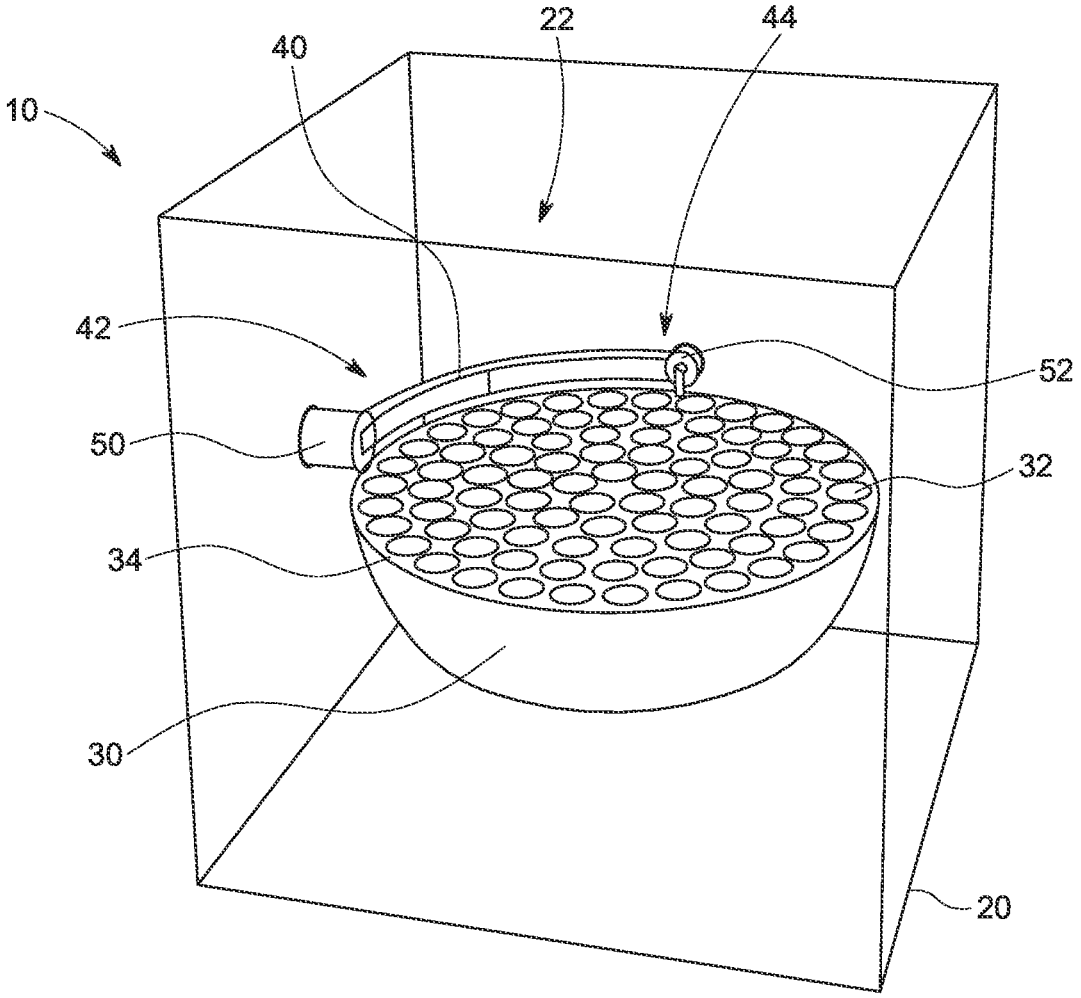

FIGS. 5-6 are perspective view illustrations of the position-control packaging apparatus 10 of FIG. 1, in accordance with the first exemplary embodiment of the present disclosure. In particular, FIGS. 5-6 are additional images which illustrate the structure and components of the apparatus 10 from slightly different perspectives for clarity in description of the subject disclosure. In particular, FIG. 5 illustrates an elevated perspective view which depicts the receptacles 32 within the inner container 30, as well as the at least one arm 40 and the joints 50, 52. FIG. 6 illustrates a side view of the apparatus 10 which clearly shows the connections between the inner container 30, the arm 40, and the joints 50, 52. All reference characters in FIGS. 5-6 are described relative to FIGS. 1-4.

Figure 7:
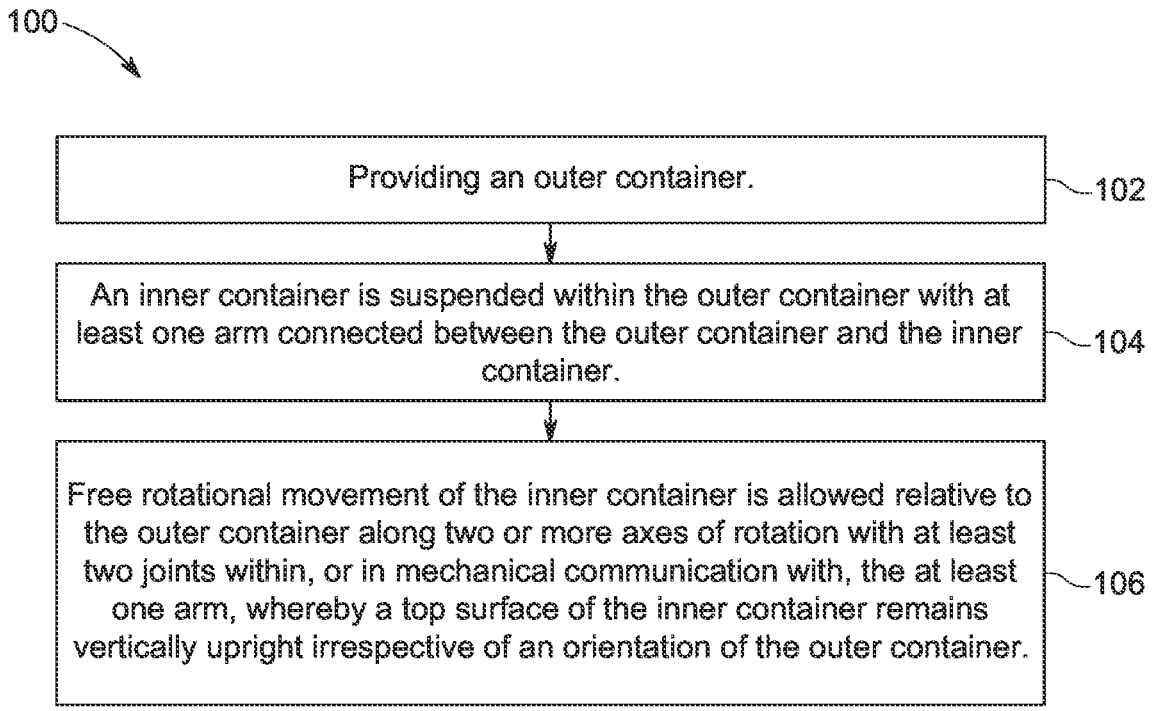
FIG. 7 is a flowchart illustrating a method of using position-control packaging, in accordance with the first exemplary embodiment of the disclosure.

FIG. 7 is a flowchart 100 illustrating a method of using position-control packaging, in accordance with the first exemplary embodiment of the disclosure. It should be noted that any process descriptions or blocks in flow charts should be understood as representing modules, segments, portions of code, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

As is shown by block 102, an outer container is provided. An inner container is suspended within the outer container with at least one arm connected between the outer container and the inner container (block 104). Free rotational movement of the inner container is allowed relative to the outer container along two or more axes of rotation with at least two joints within, or in mechanical communication with, the at least one arm, whereby a top surface of the inner container remains vertically upright irrespective of an orientation of the outer container (block 106). Any number of additional steps, functions, processes, or variants thereof may be included in the method, including any disclosed relative to any other figure of this disclosure.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed is:

1. An apparatus for position-control packaging comprising:

an outer container;

an inner container positioned within the outer container;

at least one arm connected between the outer container and the inner container, the at least one arm supporting the inner container within the outer container; and first and second joints within, or in mechanical communication with, the at least one arm, the first and second joints configured to provide free rotational movement of the inner container relative to the outer container along two or more axes of rotation, wherein the second joint is positioned between the at least one arm and the inner container, and wherein the inner container is connected to the at least one arm through only the second joint as a single point of connection.

2. The apparatus of claim 1, further comprising at least one receptacle formed within the inner container.

3. The apparatus of claim 1, wherein the inner container has curved outer edges.

4. The apparatus of claim 3, wherein the at least one arm has a curved shape which matches the curved outer edges of the inner container.

5. The apparatus of claim 1, wherein the first joint is positioned between the at least one arm and the outer container.

6. The apparatus of claim 1, wherein the outer container has a radial dimension which is larger than a radial dimension of the inner container plus any portion of the at least one arm which extends beyond a footprint of the inner container, in any orientation of the outer container.

7. The apparatus of claim 1, wherein the at least one arm is connected to the outer container at a central point of an inner face of a sidewall of the outer container.

8. The apparatus of claim 1, wherein the inner container is suspended within the outer container in a position where a center of gravity of the inner container is below a rotational axis position of a connection between the first joint and the outer container.

9. The apparatus of claim 1, wherein the inner container is connected to the at least one arm through only the second joint as a single point of connection with a second arm.

10. An apparatus for position-control packaging comprising:

an outer container;

an inner container positioned in a suspended position within the outer container;

at least a first rotatable joint connected to the outer container;

at least a first arm connected to the first rotatable joint at a first end of the first arm;

at least a second rotatable joint connected to a second end of the first arm, wherein the second end is opposite the first end; and at least a second arm connected between the second rotatable joint and the inner container, wherein the first and second rotatable joints and the first and second arms hold the inner container in the suspended position within the outer container, and wherein the inner container has free rotational movement relative to the outer container along two or more axes of rotation, wherein a top surface of the inner container remains vertically upright irrespective of an orientation of the outer container, and wherein the inner container is connected to the first and second arms through only a single point of connection.

11. The apparatus of claim 10, further comprising at least one receptacle formed within the inner container.

12. The apparatus of claim 10, wherein the inner container has curved outer edges, and wherein the first arm has a curved shape which matches the curved outer edges of the inner container.

13. The apparatus of claim 10, wherein the outer container has a radial dimension which is larger than a radial dimension of the inner container plus any portion of the first or second arms which extend beyond a footprint of the inner container, in any orientation of the outer container.

14. The apparatus of claim 10, wherein the first rotatable joint is connected to the outer container at a central point of an inner face of a sidewall of the outer container.

15. The apparatus of claim 10, wherein the inner container is suspended within the outer container in a position where a center of gravity of the inner container is below a rotational axis of the first rotatable joint.

16. A method of using position-control packaging, the method comprising:

providing an outer container;

suspending an inner container within the outer container with at least one arm connected between the outer container and the inner container; and allowing free rotational movement of the inner container relative to the outer container along two or more axes of rotation with first and second joints within, or in mechanical communication with, the at least one arm, whereby a top surface of the inner container remains vertically upright irrespective of an orientation of the outer container, wherein the second joint is positioned between the at least one arm and the inner container, and wherein the inner container is connected to the at least one arm through only the second joint as a single point of connection.

17. The method of claim 16, further comprising transporting at least one product located within at least one receptacle formed within the inner container.

18. The method of claim 16, further comprising positioning the first joint between the at least one arm and the outer container.

19. The method of claim 16, further comprising connecting the at least one arm to the outer container at a central point of an inner face of a sidewall of the outer container.

20. The method of claim 16, wherein the inner container is suspended within the outer container in a position where a center of gravity of the inner container is below a rotational axis position of a connection between the first joint and the outer container.

* * * * *